US007028658B2

(12) United States Patent
Kruse et al.

(10) Patent No.: US 7,028,658 B2
(45) Date of Patent: Apr. 18, 2006

(54) STARTING DEVICE FOR INTERNAL COMBUSTION ENGINE

(75) Inventors: Olaf Kruse, Glinde (DE); Klemens Krahn, Norderstedt (DE)

(73) Assignee: DOLMAR GmbH, Hamburg (DE)

( * ) Notice: Subject to any disclaimer, the term of this patent is extended or adjusted under 35 U.S.C. 154(b) by 0 days.

(21) Appl. No.: 10/757,912

(22) Filed: Jan. 14, 2004

(65) Prior Publication Data

US 2004/0250786 A1 Dec. 16, 2004

(30) Foreign Application Priority Data

Jan. 29, 2003 (DE) ..... 203 01 182 U

(51) Int. Cl.
*F02N 3/02* (2006.01)

(52) U.S. Cl. ..... 123/185.3

(58) Field of Classification Search ..... 123/185.14, 123/185.2, 185.3, 185.4
See application file for complete search history.

(56) References Cited

U.S. PATENT DOCUMENTS 5,287,832 A * 2/1994 Uhl ..... 123/185.3
2003/0213455 A1* 11/2003 Tohyama ..... 123/185.3

* cited by examiner

*Primary Examiner*—Andrew M. Dolinar
(74) *Attorney, Agent, or Firm*—Kelly Lowry & Kelley, LLP

(57) ABSTRACT

A starting device is provided for an internal combustion engine, in particular a pull-rope type starting device for a two-stroke or four-stroke motor. The starting device includes a pulley or rope drum which is rotatably held in a housing, and generates the drive torque for a motor shaft by means of a starter handle or pull handle. The starting device is rotatable by way of a load transfer means, in particular by way of a starter rope or pull-rope, and by way of an elastic coupling element, in particular by way of a spiral spring. A ratchet-type engaging element is provided, by means of which the drive torque can be transmitted to the motor shaft, such that not only is overloading of the elastic coupling element prevented in a safe and reliable manner, but also, even if the elastic coupling element should break, the starting still functions, and the internal combustion engine can still be started. The angle of rotation by which the engaging element can be rotated by exerting a load on the elastic coupling element in relation to the pulley or rope drum is limitable to at least one definable maximum angular value.

11 Claims, 7 Drawing Sheets

STARTING DEVICE FOR INTERNAL COMBUSTION ENGINE

TECHNICAL FIELD

The present invention relates to a starting device for at least one internal combustion engine, in particular a pull-rope type starting device for at least one two-stroke or four-stroke motor, which comprises at least one pulley or rope drum which is rotatably held in at least one housing, wherein said starting device, for generating the drive torque for the motor shaft by means of at least one handle, in particular by means of at least one starter handle or pull handle, is rotatable by way of at least one load transfer means, in particular by way of at least one starter rope or pull-rope, and by way of at least one elastic coupling element, in particular by way of at least one spiral spring, is connected to at least one engaging element, in particular to at least one ratchet-type engaging element, by means of which the drive torque can be transmitted to the motor shaft.

STATE OF THE ART

In the past, the operation of a starting device for an internal combustion engine, in particular of a pull-rope type starting device for a two-stroke or four-stroke motor, has often caused problems because during the starting process the compression in the internal combustion engine periodically leads to high reaction forces occurring as a result of which changing and temporary y very considerable forces act on the hand of the operator.

The load peaks which occur at the handle, in particular at the starter handle or pull handle of the starting device, are accordingly larger, the lighter the rotating mass of the internal combustion engine. In concrete terms this means that the torque to be produced at the motor shaft is subject to considerable fluctuations, because in the compression phase of the piston, up to the dead centre, a very considerable torque is to be produced, while in the expansion phase, the torque to be produced drops considerably, at times even dropping to zero.

In order to reduce transfer of these particularly strong reaction forces, which are caused as a result of the compression in the internal combustion engine, on the handle of the starting device, thus facilitating the starting process, printed publication DE-P 41 35 405 A1, which discloses a starting device of the type mentioned in the introduction, proposes that the fluctuations in the torque which has to be produced at the motor shaft be elastically cushioned.

To this effect, an elastic element is coupled between the pulley or rope drum associated with the load transfer means of the handle, in particular the starter rope or pull rope, and the engaging element, in particular the ratchet-type engaging element, of the crankshaft. By means of said elastic member, the pull movement during the starting process, which pull movement is transferred by the handle and the load transfer means, is somewhat freed of the above-mentioned fluctuations, or, in an ideal case, is completely freed. (An earlier attempt to design the load transfer means so as to be elastic itself led to unsafisfactory results.)

Probably the earliest proposal concerning an in-line arrangement of such an elastic coupling element is contained in the Japanese printed specification for a utility model Y-H6-16964 (Starting Industrial Co., Ltd.). The European patent application EP 1 203 883 A2 contains a newer proposal submitted by the same applicant.

Furthermore, a proposal was recently developed in which, during starting, the elastic coupling element, which is designed as a spiral spring, is rotated by an angle of rotation of approximately 270 degrees to approximately 280 degrees, which provides good starting characteristics. When this maximum angle of rotation has been reached, the spiral spring places itself against the shaft, due to becoming smaller as a result of rotation. This placement of the spiral spring against the shaft results in a blockage of any further rotation so that the engaging element of the crankshaft is forced to rotate with the pulley or rope drum.

However, in practical application, this design (=the light-start system supplied by Starting Industrial Co., Ltd., according to the so-called coil-spring principle) has been associated with disadvantages in that there is a design-related gap between the pulley or rope drum and the engaging element, with said design-related gap being defined by the longitudinal tolerance of three components, and with said design-related gap being difficult to achieve in the required quality in series production.

Consequently, due to the operating principle of the spiral spring which—blocking any further rotary movement beyond approximately 270 degrees to approximately 280 degrees—places itself around the bearing axes, a coil of this spiral spring is pushed on one side into the gap or interspace between the pulley or rope drum and the (ratchet-type) engaging element, because the spiral spring has to absorb the entire force of the load transfer means, i.e. the entire force of the pull rope.

In conclusion, this means that when a specific tolerance dimension is exceeded, at least part of a coil of the spiral spring enters the gap between the pulley or rope drum and the engaging element which are connected by the spiral spring, thus naturally becoming overstretched and sustaining permanent deformation. As a result of this, the system ceases to function properly and blocks.

Furthermore, it must be considered that during each starting process the elastic coupling element, which is a spiral spring, comes to rest on the shaft (→angular limitation of the system to approximately 270 degrees to approximately 280 degrees), and that the forces of the pull rope which are required for overcoming the compression force are only transmitted by way of the spiral spring. In extreme cases this can result in the spiral spring breaking so that the starting device ceases to function and the internal combustion engine can no longer be started at all.

It is also possible for fragments of the broken spiral spring to damage adjacent components of the starting device.

PRESENTATION OF THE INVENTION: OBJECT, IMPLEMENTATION, ADVANTAGES

Starting from the above-mentioned disadvantages and shortcomings, and acknowledging the state of the art as outlined above, it is the object of the present invention to improve a starting device of the type mentioned in the introduction such that not only is overloading of the elastic coupling element prevented in a safe and reliable manner, but also, even if the elastic coupling element should break, the starting device still functions, and the internal combustion engine can still be started.

This object is met by a starting device with the characteristics stated in claim 1. Advantageous embodiments and expedient improvements of the present invention are provided in the subordinate claims.

According to the teaching of the present invention, the angle of rotation by which the engaging element can be rotated by exerting a load on the elastic coupling element, in relation to the pulley or rope drum, can be limited to at least one definable maximum angular value, as a result of which the maximum load exerted on the elastic coupling element can be specified in a simple and yet effective way.

According to a particularly inventive improvement, this can be achieved by at least one limit stop by means of which the angle of rotation of the (ratchet-type) engagement element is limited in relation to the pulley or rope drum in order to prevent in this way any overloading of the elastic coupling element during tensioning onto the block.

Apart from the limitation, according to the invention, of the angle of rotation which occurs when the starting device is activated, i.e. when the handle is pulled, the present invention provides a further significant technical effect in that by arranging the limit stop on the engaging element, in particular on the under-side of the engaging element, which underside faces the pulley or rope drum, an "emergency starting behaviour" can be achieved in case of the elastic coupling element breaking, which elastic coupling element is arranged between the pulley or rope drum and the engaging element, so that the present invention provides an easy-start system with emergency starting characteristics:

In this case of the elastic coupling element, namely the spiral spring, breaking, for the purpose of starting the internal combustion engine the load transfer means (=starter rope or pull rope) is tightened using the handle (=starter handle or pull handle) to such an extent that the limit stop—really for the purpose of reaching the maximum angular value—contacts the rest surface and by further pulling of the load transfer means a normal or conventional starting process can be carried out.

According to a preferred embodiment of the present invention, the limit stop is provided in the form of at least one circular segment or arc-shaped segment on the underside of the (ratchet-type) engaging element, which underside faces the pulley or rope drum.

Expediently, the limit stop can engage at least one guide groove, in particular formed in the manner of a section of an arc of a circle, in the pulley or rope drum and can make it possible for both components (the engaging element and the pulley or rope drum) to rotate relative to each other until they reach the specified value of the maximum angle of rotation, before the path is limited by the circular segment or arc-shaped segment resting against the closed end of the guide groove.

Advantageously, the end of the guide groove is formed by at least one limit stop damper, preferably made of elastomer, so that the end of the rotary movement can be stopped in a damped manner.

In order to achieve as even a load distribution as possible when the starting device is activated, i.e. when the handle is pulled, according to a particularly advantageous embodiment of the present invention, two limit stops can be provided. This prevents any moment of tilt from being transferred to the associated components of the starting device according to the present invention.

In order to achieve the desired even load distribution in as precise a form as possible and in order to prevent any transfer of the moment of tilt to the involved components of the starting device as completely as possible, it is recommended that the two limit stops be arranged

- so as to be essentially diametrically opposed to each other, and/or
- so as to be offset by approximately 180 degrees in relation to each other.

In this preferred embodiment, for the purpose of achieving the maximum angular value, the two limit stops come to rest at the same time, in particular at the end of the respective guide groove.

Correspondingly, each of the two limit stops can then be guided in at least one guide groove each, preferably a guide groove of semicircular arc-shaped section, wherein expediently these two guide grooves are arranged in the pulley or rope drum

- so as to be mirror inverted; and/or
- so as to be offset by approximately 180 degrees in relation to each other.

Depending on the number of the limit stops provided, the maximum angular value which is defined when the starting device is activated, in particular when the handle is pulled, results, with said maximum angular value being in the magnitude of approximately 270 degrees to approximately 280 degrees divided by the number of limit stops used, i.e. in particular

- in the magnitude of approximately 270 degrees to approximately 280 degrees if one limit stop is provided; or
- in the magnitude of approximately 135 degrees to approximately 140 degrees if two limit stops are provided.

In other words, this means that if two limit stops are used, only half of the maximum angular value is achieved in comparison to the use of one limit stop. This fact of shorter (spring) travel and consequently a reduced load on the elastic coupling element (→less wear and increased service life) goes hand in hand with further technical advantages in that when two limit stops are used, not only is it possible to prevent the occurrence of moments of tilt, but it is also possible to transfer greater forces, which is of interest in particular in the case of motors with greater volumetric displacement.

With the type of design, as explained above, of the starting device according to the present invention—independently of the concrete number of limit stops provided—the travel of the elastic coupling element (spring travel) or the angle of rotation can be controlled in a targeted way, i.e. the elastic coupling element now only absorbs the force up to the end of travel and consequently is no longer overloaded when it places itself against the shaft—which of course also has a positive effect on the service life of the elastic coupling element.

If the elastic coupling element, i.e. the spiral spring, breaks nevertheless, the starting device loses its comfortable damping characteristics during the starting process; however, the operator continues to be able to start the internal combustion engine. Consequently, in the present starting device the provision of the limit stop is of essential importance in that during breakage of the elastic coupling element it is no longer the case that the entire work tool, for example the entire chainsaw, ceases to function, as has conventionally been the case.

Instead, the provision of an end stop ensures that if the spiral spring breaks, only the basically desired soft pulling behaviour during the starting process is lost, while the starting device—after overcoming the "idle" up to the limit stop—is operable like a normal starter. Accordingly, operators can determine a convenient time for repair (exchanging the broken elastic coupling element) without being hindered in their work or being forced into an inconvenient interruption of their work.

According to a particularly inventive improvement of the present starting device the elastic coupling element, in particular the spiral spring, is pretensioned, i.e. comprises pretension, so that already at the very start of the rotary movement between the pulley or rope drum and the (ratchet-type) engaging element, force transferred by way of the elastic coupling element can start, or the forces which can be transmitted by way of the elastic coupling element can be greater because a region of the characteristic curve of the elastic coupling element, in particular of the spring characteristic curve, can be exploited, which region differs from that of the state of the art.

In a particularly synergetic way, the provision of at least one elastic coupling element, which is pretensioned or comprises pretension, can be combined with the above-described provision of at least one limit stop by means of which the angle of rotation of the (ratchet-type) engagement element is limited in relation to the pulley or rope drum.

As a result of the above-described technical measures according to the present invention, the starting device which hitherto was only suitable with limitations, namely in the area of leisure and hobby applications, is now also useable for the professional market.

Furthermore, the present invention relates to a starting device for at least one internal combustion engine, in particular a pull-rope type starting device for at least one two-stroke or four-stroke motor, which comprises at least one pulley or rope drum which is rotatably held in at least one housing, wherein said starting device, for generating the drive torque for the motor shaft by means of at least one handle, in particular by means of at least one starter handle or pull handle, is rotatable by way of at least one load transfer means, in particular by way of at least one starter rope or pull-rope, and by way of at least one pretensioned elastic coupling element or an elastic coupling element comprising pretension, in particular by way of at least one spiral spring, is connected to at least one engaging element, in particular to at least one ratchet-type engaging element, by means of which the drive torque can be transmitted to the motor shaft.

Because the elastic coupling element, in particular the spiral spring, is pretensioned, or comprises pretension, already at the very start of the rotary movement between the pulley or rope drum and the (ratchet-type) engaging element, force transfer by way of the elastic coupling element can start, or the forces which can be transmitted by way of the elastic coupling element can be greater because a region of the characteristic curve of the elastic coupling element, in particular of the spring characteristic curve, can be exploited, which region differs from that of the state of the art.

Furthermore, the present invention relates to an internal combustion engine, in particular a two-stroke or four-stroke motor, comprising at least one starting device of the type described above.

Furthermore, the present invention relates to a work tool, in particular a portable hand tool powered by an internal combustion engine, such as for example a brush cutter, a chainsaw, a motor saw, an abrasive cutting-off machine or the like, comprising at least one internal combustion engine of the type described above, which internal combustion engine comprises at least one starting device of the type described above.

Finally, the present invention relates to the use of at least one starting device according to the type described above, comprising at least one internal combustion engine according to the type described above, for a work tool according to the type described above.

BRIEF DESCRIPTION OF THE DRAWINGS

As has already been explained above, there are various options to advantageously implement and improve the teaching of the present invention. To this effect, reference is made to the claims which are subordinate to claim 1. Moreover, further embodiments, characteristics and advantages of the present invention are explained in detail below, with reference to the embodiments shown in FIGS. 1 to 7B.

The following are shown.

Identical or similar embodiments, elements or characteristics in FIGS. 1 to 7B are designated by means of identical reference characters.

THE BEST WAY OF IMPLEMENTING THE INVENTION

Figure 1:
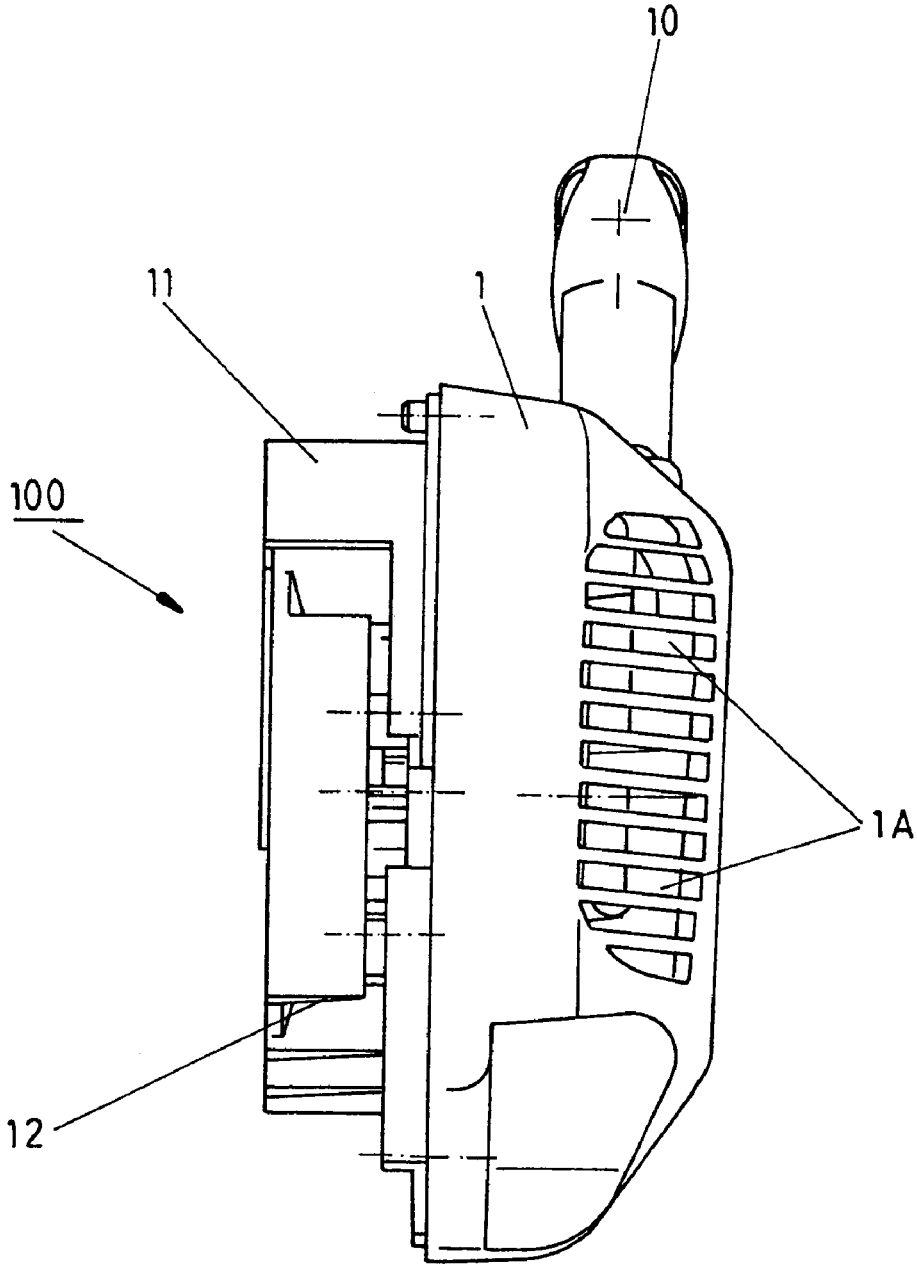
FIG. 1 a diagrammatic front view of an embodiment of a starting device, accommodated in a housing, according to the present invention.
Figure 2:
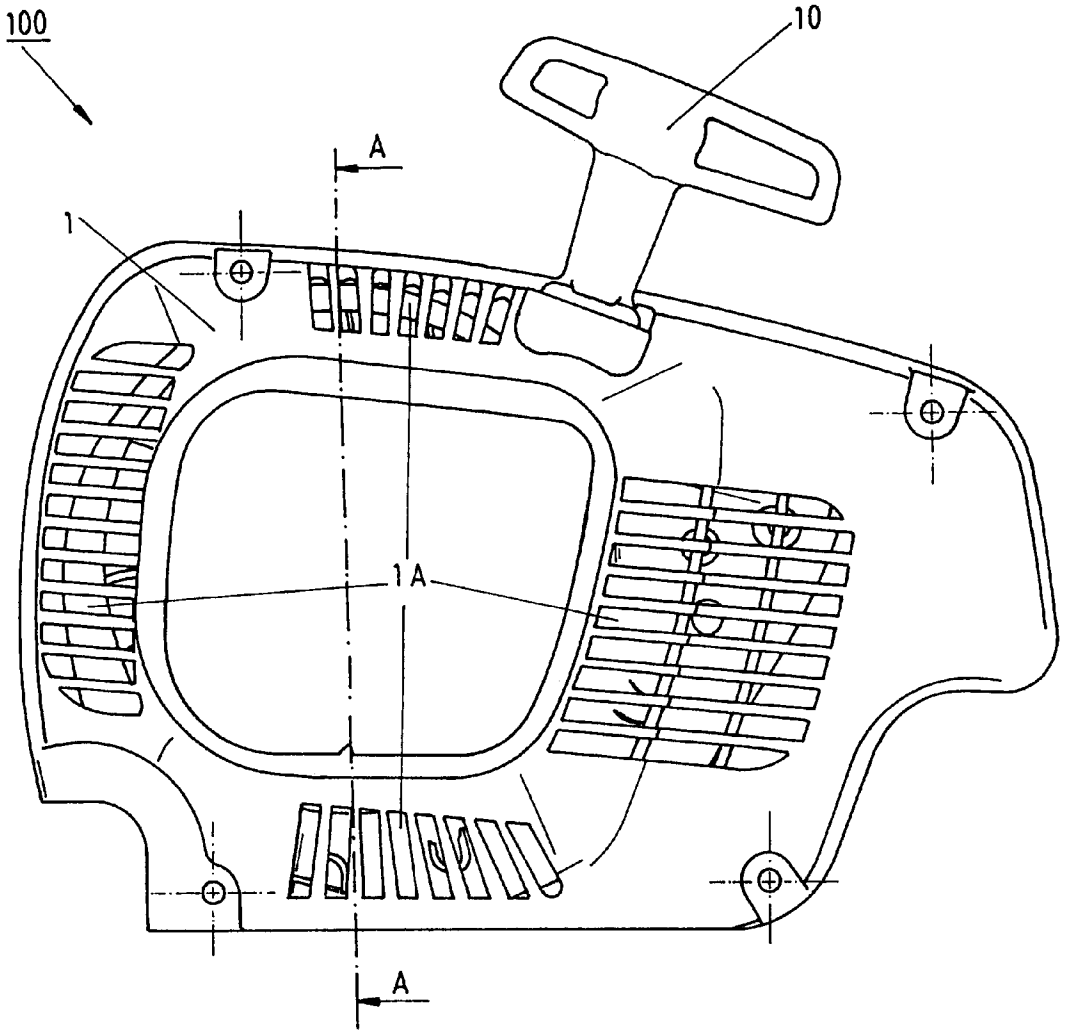
FIG. 2 a diagrammatic side view of the starting device shown in FIG. 1, accommodated in a housing.

The pull-rope type starting device 100 according to FIGS. 1 to 7B is intended for manual starting of an internal combustion engine (two-stroke or four-stroke motor) which for example forms part of a motor chainsaw. The pull-rope type starting device 100 is accommodated in a housing 1 which both in the first embodiment according to FIGS. 1, 2, 3, 4A, 4B, 5A, 5B and in the second embodiment according to FIGS. 1, 2, 3, 6A, 6B, 7A, 7B is a removable cover, comprising ventilating slots 1A (compare FIGS. 1, 2 and 3) of the motor housing which among other things also comprises an air duct 11 as well as an adjacent cog wheel 12 with the ratchet-arrangement (not shown) for transfer of the flow of force from the engaging element to the crankshaft.

The internal wall of the housing 1 (which internal wall is facing to the right in FIG. 3) comprises a bearing journal 1B which is surrounded by a spring housing 3, which is also essentially arranged so as to be fixed in the housing, for a spiral-shaped starter spring 2 which is clamped in on one side at the rim of the spring housing 3. This starter spring 2 is covered by a (metal) disc 3A towards a clutch drum (compare FIGS. 4A and 4B or alternatively FIGS. 6A and 6B) which clutch drum 4 is in the form of a pulley or rope drum 4; said starter spring 2 serves as a pull-back spring for the pulley or rope drum 4.

The pulley or rope drum 4 comprises a rear journal 4A (compare FIG. 3) which protrudes through a centre borehole of the (metal) disc 3A into the spring housing 3 and comprises an axial slot 4B for engagement of the inner end of the spiral-shaped starter spring 2.

Wound on the pulley or rope drum 4 is a starter rope or pull rope 9, as a load transfer means, with the free end of said starter rope or pull rope 9 leading out of the housing 1 and being attached to a handle 10, namely to a starter handle or pull handle. By pulling the starter rope or pull rope 9 by means of the handle 10, the pulley or rope drum 4 is made to rotate on the bearing journal 1B as a result of the starter rope or pull rope 9 unwinding.

The pulley or rope drum 4 comprises a ring-shaped accommodation space 4C which surrounds the bearing journal 1B, with said accommodation space 4C towards the starter spring 2 being delimited by a face wall 4D. An elastically deformable coupling element 6 in the form of a spiral spring is arranged between this face wall 4D of the pulley or rope drum 4 and a ring-shaped accommodation space 5A of a ratchet-type engaging element 5.

The outer end, i.e. the end of the face wall 4D which faces the pulley or rope drum 4, of the elastic coupling element 6 is hooked into a slot 16 (compare FIGS. 4A and 4B or alternatively FIGS. 6A and 6B), which slot has been provided in a ring-shaped shoulder of the face wall 4D. This shoulder encompasses the spiral-spring shaped coupling element 6 whose outer coil rests against the interior wall of the shoulder. The inner end, i.e. the end of the elastic coupling element 6 which points towards a face wall 5B of the ring-shaped accommodation space 5A of the ratchet-type engaging element 5, is held, so as to be axially displaceable, in an opening 17 (compare FIG. 5B or alternatively FIG. 7B) provided in the face wall 5B.

In the installed state of the starting device 100, the bearing journal 1B, which is arranged so as to be fixed in the housing, passes through a centre borehole 4E (compare FIGS. 4A and 4B or alternatively FIGS. 6A and 6B) of the face wall 4D of the pulley or rope drum 4 so that said centre borehole 4E forms a bushing-shaped accommodation space for the bearing journal 1B. An attachment screw 7 (compare FIG. 3) is screwed into an axial interior thread 1C (compare FIG. 3) of the bearing journal 1B. At the head of said attachment screw 7 there is a ring-shaped shoulder 7A (compare FIG. 3) by means of which the ratchet-type engaging element 5 is attached to the free end of the bearing journal 1B by way of a centre borehole 5C (compare FIGS. 3 and 5B or alternatively FIGS. 3 and 7B) which provides an exact fit for the shoulder 7A of the attachment screw 7.

When the pulley or rope drum 4 is made to rotate by the starter rope or pull rope 9 being pulled, the pulley or rope drum 4 takes along the ratchet-type engaging element 5 by way of the elastic coupling element 6, because the pulley or rope drum 4 and the ratchet-type engaging element 5 are connected on a mutual axle by means of the elastic coupling element 6. By means of this ratchet-type engaging element 5, the rotary movement of the pulley or rope drum 4 and thus the torque can be transferred to the motor shaft to be driven.

Basically, when the motor shaft is driven or rotated, the compression in the internal combustion engine increases until the top dead-centre position of the piston has been reached, then it decreases. The reaction torque periodically fluctuates in accordance with the above, which in a conventional starting device is reflected in high load peaks which during starting, i.e during activation of a conventional starting device, have to be provided. The above-described elastically is provided to compensate for these periodic changes in the force to be provided; in the two embodiments shown according to FIGS. 1 to 7B said deformable coupling element 6 is a spiral spring 6.

This spiral spring 6 is dimensioned such that the ratchet-type engaging element 5 is taken along by the rotating pulley or rope drum 4, as long as the reaction torque of the motor shaft remains below a specified limiting value, wherein the piston of the internal combustion engine is located in the regions in front of and behind its dead centre position. When the reaction torque increases beyond this limiting value, the spiral spring 6 becomes deformed in that its coils are constricted so that the rotary speed of the ratchet-type engaging element 5 decreases, while the pulley or rope drum 4 can continue to rotate at the same rotary speed and at approximately the same expenditure of force.

Consequently, the pulley or rope drum 4 rotates additionally, relative to the ratchet-type engaging element 5 which has been inserted into the pulley or rope drum 4 with little play. The height of the spiral spring 6, which spiral spring 6 is made from circular or rectangular spring steel, is such that the face wall 5B of the engaging element 5 does not touch the spiral spring 6 even at maximum spring force. Because the upper suspension point 17 is displaced, the occurring axial change in the length of the spiral spring 6 is not translated into an axial force component acting on the ratchet-type engaging element 5.

Figure 3:
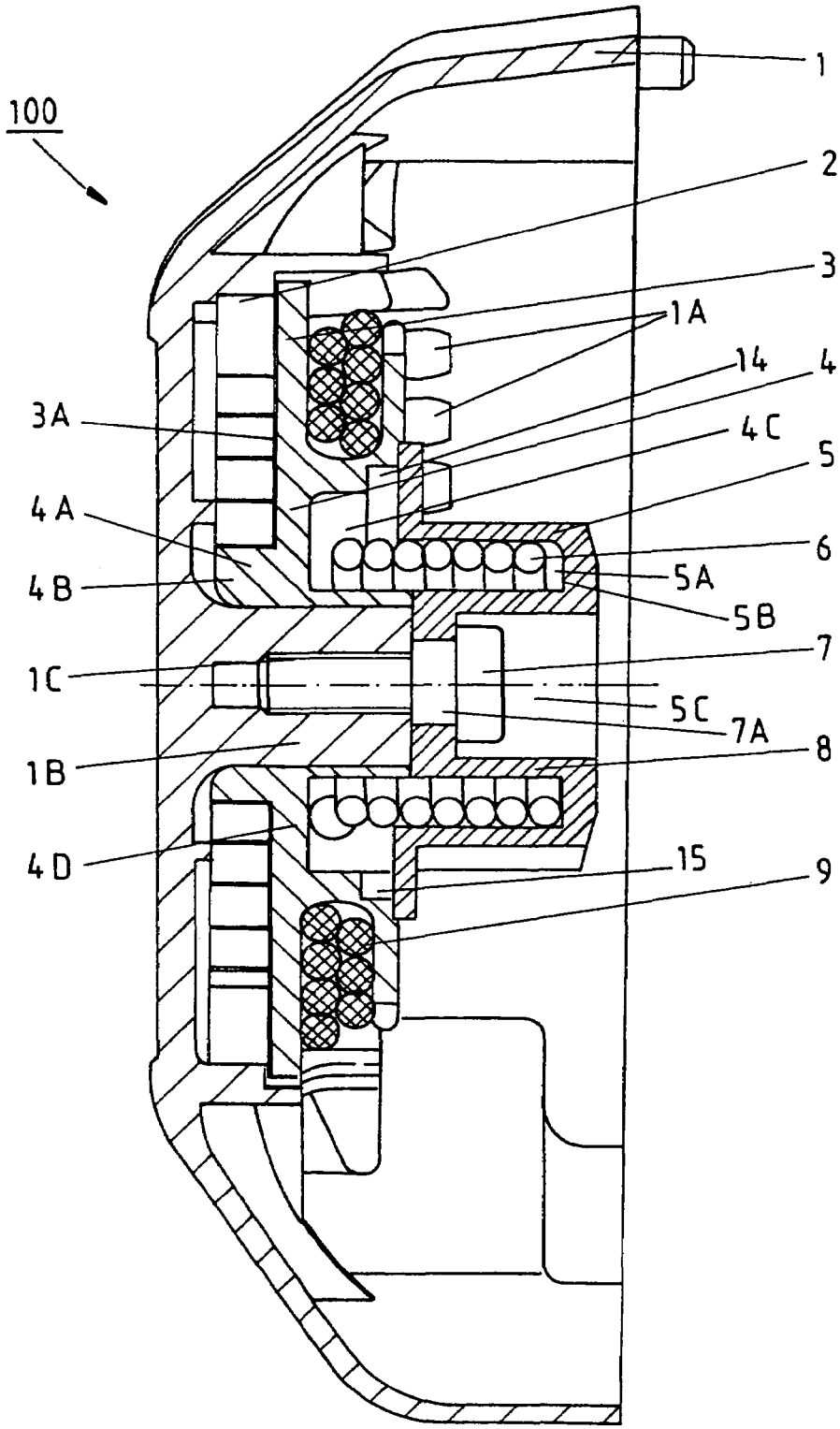
FIG. 3 an enlarged diagrammatic section view of the starting device shown in FIGS. 1 and 2 along the sectional line A—A in FIG. 2.
Figure 4A:
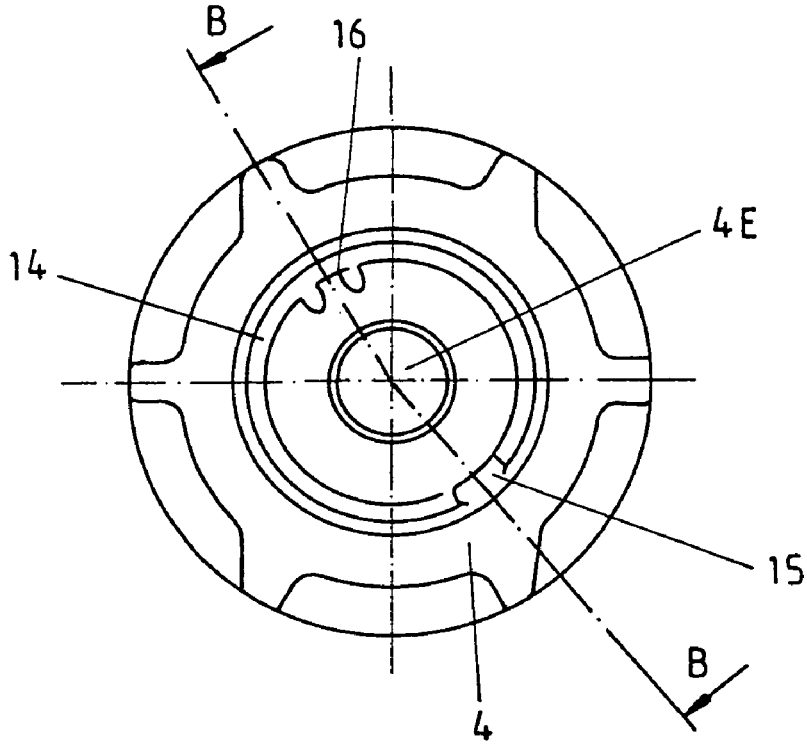
FIG. 4A a diagrammatic top view of an embodiment of a pulley or rope drum according to the present invention, with said pulley or rope drum being associated with the starting device shown in FIGS. 1 to 3.
Figure 4B:
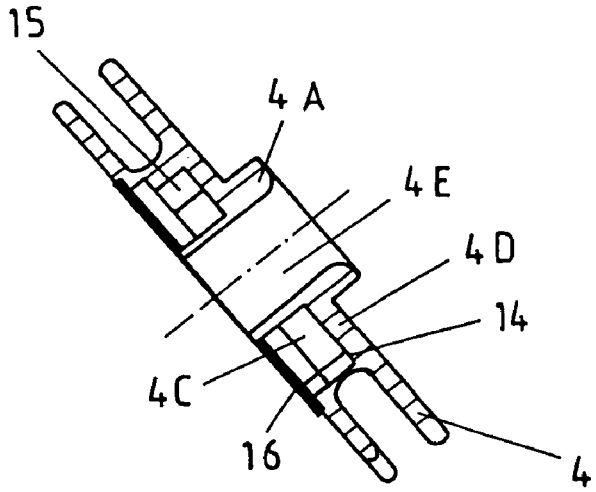
FIG. 4B a diagrammatic section view of the pulley or rope drum shown in FIG. 4A along the sectional line B—B in FIG. 4A.

As can be seen from the sectional view according to FIG. 3, in the abovementioned embodiment of the starting device 100 a design-related gap results between the axle of the pulley or rope drum 4 and the axle of the ratchet-type engaging element 5, and consequently also between the axle of the pulley or rope drum 4 and the elastic coupling element 6.

In order to simply, effectively and reliably prevent a coil of the elastic coupling element 6 or part of a coil of the elastic coupling element 6 from entering this design-related gap between the pulley or rope drum 4 and the ratchet-type engaging element 5, this gap can be filled by means of a thin-walled bushing or sleeve 8 in the shape of a hollow cylinder.

Consequently, by inserting the simple bushing or sleeve 8 in the design-related gap, any breaking of the elastic coupling element 6, which is designed as a spiral spring, as a result of a coil of the spiral spring 6 entering the separation joint between the pulley (=rope drum 4) and the ratchet-type engaging element 5 can be prevented. The bushing or sleeve 8 is put over the two opposite shaft ends so that any deformation of the elastic coupling element 6, which is a spring, is safely prevented.

Accordingly, when the starting device 100 is activated, i.e. when the handle 10 is pulled, the elastic coupling element, i.e. the spring 6, now places itself around the bushing or sleeve 8 which is guided so as to be torsionally rigid on the axle of the pulley or rope drum 4, and which bushing or sleeve 8 has play in relation to the axle of the engaging element 5. Likewise, guiding the sleeve on the engaging element while providing play to the pulley would be an equivalent solution. A floating bearing arrangement is not feasible because the motor vibrations are too strong.

FIG. 3 further shows that the bushing or sleeve 8 essentially extends along the entire height or length of the elastic coupling element 6. In a way which is significant in the context of the invention, the height or length of the bushing or sleeve 8 approximately corresponds to the sum of the depth of the accommodation space 4C of the pulley or rope drum 4; and of the depth of the accommodation space 5A of the ratchet-type engaging element 5.

The required operating gap (=design-related gap or design-related separation joint) between the axle of the pulley or rope drum 4 and the axle of the ratchet-type engaging element 5 no longer has any influence on the elastic coupling element 6. As a result, the tolerances can be larger, which in turn makes it possible to produce the starting device 100 more economically.

In order to limit the relative movement between the pulley or rope drum 4 and the ratchet-type engaging element 5 in the case of the first embodiment according to FIGS. 1, 2, 3, 4A, 4B, 5A, 5B and in this way to prevent any overload of the elastic coupling element 6, the angle of rotation by which the ratchet-type engaging element 5 is rotatable in relation to the pulley or rope drum 4 by exerting a load on the elastic coupling element 6, is limitable, in the starting operation of the first embodiment, to a specifiable maximum angular value in the magnitude of approximately 270 degrees to approximately 280 degrees. This provides good starting characteristics.

When this maximum angle of rotation in the magnitude of approximately 270 degrees to approximately 280 degrees has been reached, the spiral spring 6 places itself against the shaft, due to becoming smaller as a result of rotation. In the first embodiment according to FIGS. 1 to 5B, this placement of the spiral spring 6 against the shaft results in a blockage of any further rotation so that the ratchet-type engaging element 5 of the crankshaft is forced to rotate with the pulley or rope drum 4.

Figure 5A:
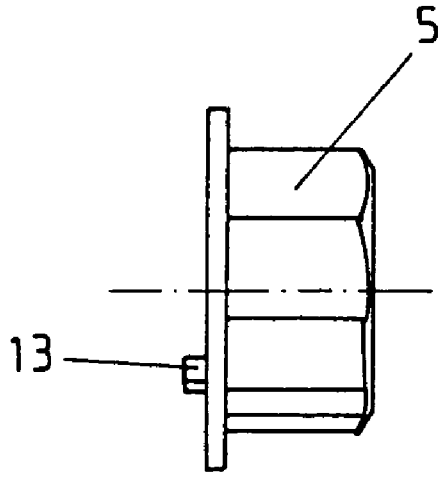
FIG. 5A a diagrammatic lateral view of an embodiment of a (ratchet-type) engaging element according to the present invention, which engaging element is associated with the starting device shown in FIGS. 1 to 3, and in particular associated with the pulley or rope drum shown in FIGS. 4A and 4B.
Figure 5B:
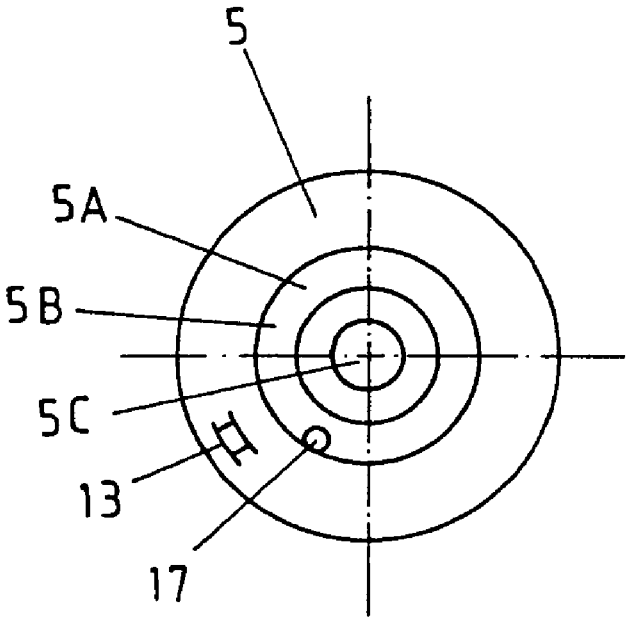
FIG. 5B a diagrammatic top view of the (ratchet-type) engaging element shown in FIG. 5A.

Consequently, the maximum load of the elastic coupling element 6 can be specified in a simple and yet effective and reliable way. As shown in FIGS. 5A and 5B, in the first embodiment this is achieved by providing a limit stop 13 by means of which the angle of rotation of the ratchet-type engaging element 5 is limited in relation to the pulley or rope drum 4 in order to prevent, in this way, any overloading of the elastic coupling element 6 during tensioning onto the block.

Apart from the limitation of the angle of rotation to maximum angular values to a magnitude of approximately 270 degrees to approximately 280 degrees when the starting device 100 is activated, i.e. when the handle 10 is pulled, there is a further significant technical effect in the case of the first embodiment of the starting device 100 in that as a result of the limit stop 13 forming itself to the underside of the ratchet-type engaging element 5 (=outer flange of the ratchet-type engaging element 5), which underside faces the pulley or rope drum 4, an "emergency starting behaviour" can be achieved in the (very unlikely) case of the elastic coupling element 6 breaking, which elastic coupling element 6 is arranged between the pulley or rope drum 4 and the ratchet-type engaging element 5, so that an easy-start system 100 with emergency starting characteristics is provided:

In this case of the elastic coupling element, namely the spiral spring 6, breaking, for the purpose of starting the internal combustion engine the load transfer means 9 (=starter rope or pull rope) is tightened using the handle 10 (=starter handle or pull handle) to such an extent that the limit stop 13—really for the purpose of reaching the maximum angular value—contacts the rest surface 15 (compare FIGS. 4A and 4B) and by further pulling of the load transfer means 9 a normal or conventional starting process can be carried out.

Irrespective as to whether in regular operation (⇆undamaged elastic coupling element 6) or in emergency operation (⇆damaged elastic coupling element 6), the limit stop 13, which is in the form of a circular segment or arc-shaped segment, in the first embodiment according to FIGS. 1 to 5B, engages a guide groove 14 which is provided on the face of the pulley or rope drum 4 which faces the ratchet-type engaging element 5 in said pulley or rope drum 4 and makes possible for both components (ratchet-type engaging element 5 and pulley or rope drum 4) relative rotation of up to approximately 270 degrees to approximately 280 degrees in relation to each other before the path is limited by the circular segment or arc-shaped segment 13 coming to rest against the closed end 15 (=limit stop buffer made from rubber-elastic material→the end of the rotary movement is stopped in a damped way) of the guide groove 14.

In order to limit the relative movement between the pulley or rope drum 4 and the ratchet-type engaging element 5 in the case of the second embodiment according to FIGS. 1, 2, 3, 6A, 6B, 7A, 7B and in this way to prevent any overload of the elastic coupling element 6, the angle of rotation by which the ratchet-type engaging element 5 is rotatable in relation to the pulley or rope drum 4 by exerting a load on the elastic coupling element 6, is limitable, in the starting operation of the second embodiment, to a specifiable maximum angular value in the magnitude of approximately 135 degrees to approximately 140 degrees. This provides good starting characteristics.

When this maximum angle of rotation in the magnitude of approximately 135 degrees to approximately 140 degrees has been reached, the spiral spring 6 places itself against the shaft, due to becoming smaller as a result of rotation. In the second embodiment according to FIGS. 1, 2, 3, 6A, 6B, 7A, 7B, this placement of the spiral spring 6 against the shaft results in a blockage of any further rotation so that the ratchet-type engaging element 5 of the crankshaft is forced to rotate with the pulley or rope drum 4.

Figure 7A:
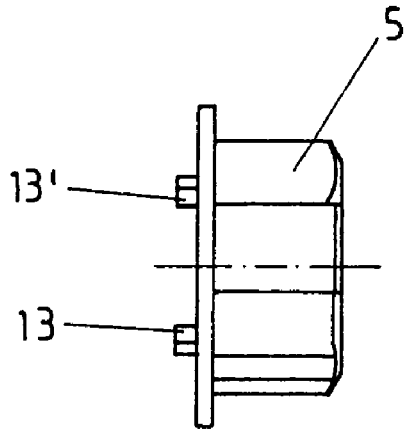
FIG. 7A a diagrammatic lateral view of an embodiment of a (ratchet-type) engaging element according to the present invention, which engaging element is associated with the starting device shown in FIGS. 1 to 3, and in particular associated with the pulley or rope drum shown in FIGS. 6A and 6B.
Figure 7B:
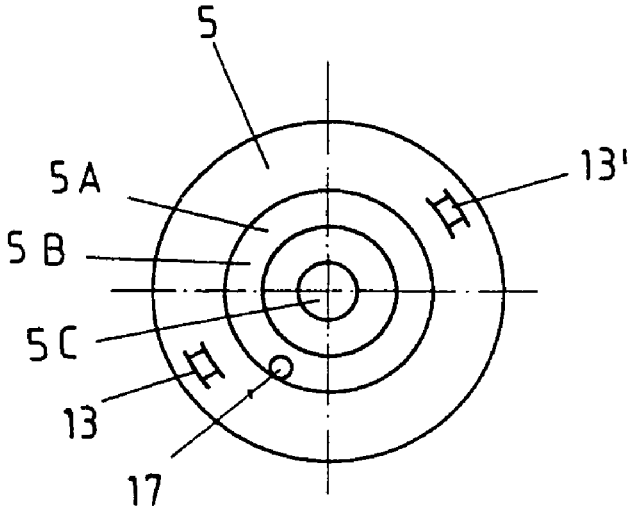
FIG. 7B a diagrammatic top view of the (ratchet-type) engaging element shown in FIG. 7A.

Consequently, the maximum load of the elastic coupling element 6 can be specified in a simple and yet effective and reliable way. As shown in FIGS. 7A and 7B, in the second embodiment this is achieved by providing two limit stops 13, 13' by means of which the angle of rotation of the ratchet-type engaging element 5 is limited in relation to the pulley or rope drum 4 in order to prevent, in this way, any overloading of the elastic coupling element 6 during tensioning onto the block.

Unlike the first embodiment according to FIGS. 1, 2, 3, 4A, 4B, 5A, 5B in which only one limit stop 13 is provided, the second embodiment according to FIGS. 1, 2, 3, 6A, 6B, 7A, 7B comprises two limit stops 13, 13' in order to achieve as even a load distribution as possible when the starting device 100 is activated, i.e. when the handle is pulled. This prevents any moment of tilt from being transferred to the associated components of the starting device 100.

In order to achieve the desired even load distribution in as precise a form as possible and in order to prevent any transfer of the moment of tilt to the involved components of the starting device 100 as completely as possible, the two limit stops 13, 13' in the second embodiment are essentially diametrically opposed to each other, i.e. they are arranged so as to be offset by approximately 180 degrees in relation to each other (compare FIGS. 7A and 7B).

Figure 6A:
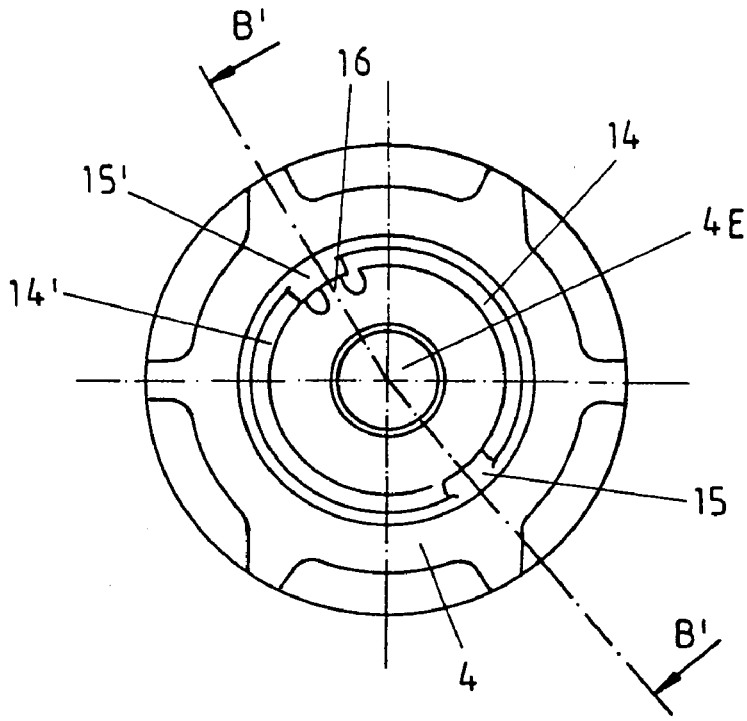
FIG. 6A a diagrammatic top view of an embodiment which is an alternative to the embodiment shown in FIG. 4A, of a pulley or rope drum according to the present invention, with said pulley or rope drum being associated with the starting device shown in FIGS. 1 to 3.
Figure 6B:
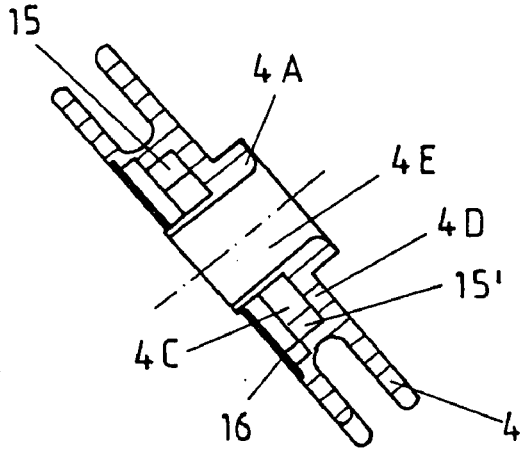
FIG. 6B a diagrammatic section view of the pulley or rope drum shown in FIG. 6A along the sectional line B'—B' in FIG. 6A.

Accordingly, in the second embodiment, each of the two limit stops 13 or 13' is guided in a semicircular arc-shaped guide groove 14 or 14' (compare FIGS. 6A and 6B), wherein these two guide grooves 14, 14' are arranged so as to be essentially mirror inverted, i.e. arranged offset by approximately 180 degrees in relation to each other in the pulley or rope drum 4 (compare FIGS. 6A and 6B).

The above explanations show that if two limit stops 13, 13' (compare the second embodiment according to FIGS. 1, 2, 3, 6A, 6B, 7A, 7B) only half the maximum angular value is achieved in comparison to the use of one limit stop 13 (compare the first embodiment according to FIGS. 1 to 5B). This fact of shorter (spring) travel and consequently a reduced load on the elastic coupling element 6 (→less wear and increased service life) goes hand in hand with further technical advantages in that when two limit stops 13, 13' are used, not only is it possible to prevent the occurrence of moments of tilt, but it is also possible to transfer greater forces, which is of interest in particular in the case of motors with greater volumetric displacement.

Apart from the limitation of the angle of rotation to maximum angular values to a magnitude of approximately 135 degrees to approximately 140 degrees when the starting device 100 is activated, i.e. when the handle 10 is pulled, there is a further significant technical effect in the case of the second embodiment of the starting device 100 in that as a result of the two limit stops 13, 13' forming themselves to the underside of the ratchet-type engaging element 5 (=outer flange of the ratchet-type engaging element 5), which underside faces the pulley or rope drum 4, an "emergency starting behaviour" can be achieved in the (very unlikely) case of the elastic coupling element 6 breaking, which elastic coupling element 6 is arranged between the pulley or rope drum 4 and the ratchet-type engaging element 5, so that an easy-start system 100 with emergency starting characteristics is provided:

In this case of the elastic coupling element, namely the spiral spring 6, breaking, for the purpose of starting the internal combustion engine the load transfer means 9 (=starter rope or pull rope) is tightened using the handle 10 (=starter handle or pull handle) to such an extent that the two limit stops 13, 13'—really for the purpose of reaching the maximum angular value—contact the respective rest surfaces 15, 15' (compare FIGS. 6A and 6B) and by further pulling of the load transfer means 9 a normal or conventional starting process can be carried out.

Irrespective as to whether in regular operation (⇆undamaged elastic coupling element 6) or in emergency operation (⇆damaged elastic coupling element 6), each of the two limit stops 13 or 13', which is in the form of a circular segment or arc-shaped segment, in the second embodiment according to FIGS. 1, 2, 3, 6A, 6B, 7A, 7B, engage a guide groove 14 or 14' which is provided on the face of the pulley or rope drum 4 which faces the ratchet-type engaging element 5 in said pulley or rope drum 4 and makes possible for both components (ratchet-type engaging element 5 and pulley or rope drum 4) relative rotation of up to approximately 135 degrees to approximately 140 degrees in relation to each other before the path is limited by the circular segment or arc-shaped segment 13 or 13' coming to rest against the closed end 15 or 15' (=limit stop buffer made from rubber-elastic material→the end of the rotary movement is stopped in a damped way) of the guide groove 14 or 14'.

In this arrangement the two limit stops 13 or 13' in the second embodiment, for the purpose of achieving the maximum angular value, contact the rest surfaces 15 or 15' simultaneously at the end of the respective guide groove 14 or 14', so that the desired even load distribution is implemented in a particularly precise form and so that any transfer of the moment of tilt to the involved components of the starting device 100 is completely prevented.

As a result of this type of design of the starting device 100 according to FIGS. 1 to 7B, the travel of the elastic coupling element 6 (spring travel) or the angle of rotation is controlled in a targeted way, i.e. the elastic coupling element 6 now only absorbs the force up to the end of travel and consequently is no longer overloaded when it places itself against the shaft—which of course also has a positive effect on the service life of the elastic coupling element 6.

If the elastic coupling element 6, i.e. the spiral spring, breaks nevertheless, the starting device 100 loses its comfortable damping characteristics during the starting process; however, the operator continues to be able to start the internal combustion engine. Consequently, in the present starting device 100, the following are of essential importance in that during breakage of the elastic coupling element 6 it is no longer the case that the entire work tool, for example the entire chainsaw, ceases to function:

- the provision of the limit stop 13 in the case of the first embodiment according to FIGS. 1, 2, 3, 4A, 4B, 5A, 5B; or
- the provision of the two limit stops 13, 13' in the case of the second embodiment according to FIGS. 1, 2, 3, 6A, 6B, 7A, 7B.

Instead, the provision of

- the limit stop 13 in the case of the first embodiment according to FIGS. 1, 2, 3, 4A, 4B, 5A, 5B; or
- the two limit stops 13, 13' in the case of the second embodiment according to FIGS. 1, 2, 3, 6A, 6B, 7A, 7B ensures that if the spiral spring 6 breaks, only the basically desired soft pulling behaviour during the starting process is lost, while the starting device 100—after overcoming the "idle" up to the limit stop—is operable like a normal starter. Accordingly, operators can determine a convenient time for repair (exchanging the broken elastic coupling element 6) without being hindered in their work or being forced into an inconvenient interruption of their work.

If the reaction torque, after the dead centre position of the motor piston has been exceeded, again fails to achieve the specified limiting value, then the elastic coupling element 6 relaxes again up to its home position, wherein the ratchet-type engaging element 5, which is being taken along by the coupling element 6, moves in the direction of rotation, relative to the pulley or rope drum 4.

The elastic coupling element 6 thus at the same time acts as an energy store which gives off the energy, which has been stored during the just completed deformation, to the ratchet-type engaging element 5 and accelerates said ratchet-type engaging element 5 such that it temporarily reaches a higher absolute rotary speed than does the pulley or rope drum 4, before again rotating at the speed of said pulley or rope drum 4.

The starter spring 2 has been provided to return the pulley or rope drum 4 to its home position so that the starter rope or pull rope 9, having been pulled out, is subsequently rewound onto the pulley or rope drum 4 as is customary in pull-rope type starting devices. Since the spring housing 3 is covered by the (metal) disc 3A, there is only a small amount of friction between the spring housing 3 and the pulley or rope drum 4 when said pulley or rope drum 4 is rotated.

Most of the components of the starting device 100 according to FIGS. 1 to 7B are made from plastic materials, including for example the housing 1, the spring housing 3, the pulley or rope drum 4, as well as the ratchet-type engaging element 5. The elastic coupling element 6 is made from circular or rectangular spring steel, while the metal of the installed bushing or sleeve 8 is hardened. Not least due to the above-mentioned selection of materials, production and installation of the starting device 100 according to the present invention are particularly cost-effective.

Finally, reference is made to the characteristic which is significant in the context of the invention, and which is connected with the above-mentioned explanations, or is independent of the above-mentioned explanations wherein the elastic coupling element 6, i.e. the spiral spring, is pretensioned, i.e. can comprise pretension, both in the first embodiment according to FIGS. 1, 2, 3, 4A, 4B, 5A, 5B and in the second embodiment according to FIGS. 1, 2, 3, 6A, 6B, 7A, 7B.

Among other things, this results in a positive technical effect in that already at the very start of the rotary movement between the pulley or rope drum 4 and the ratchet-type engaging element 5, transfer of force by way of the elastic coupling element 6 can start, and/or the forces which can be transferred by way of the elastic coupling element 6 can be greater because a region of the characteristic curve of the elastic coupling element 6, i.e. of the spring characteristic curve, can be exploited, which region differs from that of the state of the art.

In a particularly synergetic way, installation of the elastic coupling element 6, which is pretensioned, or which comprises pretension, can be combined with the above-described provision of a limit stop 13 by means of which the angle of rotation of the ratchet-type engaging element 5 relative to the pulley or rope drum 4 can be limited to a maximum angle of rotation in the magnitude of approximately 270 degrees to approximately 280 degrees (=first embodiment according to FIGS. 1 to 5B); or two limit stops 13 and 13' by means of which the angle of rotation of the ratchet-type engaging element 5 relative to the pulley or rope drum 4 can be limited to a maximum angle of rotation in the magnitude of approximately 135 degrees to approximately 140 degrees (=second embodiment according to FIGS. 1, 2, 3, 6A, 6B, 7A, 7B).

The invention claimed is:

1. A starting device for an internal combustion engine, in particular a pull-rope type starting device for a two-stroke or four-stroke motor, which comprises at least one pulley or rope drum which is rotatably held in a housing, wherein said starting device, for generating the drive torque for a motor shaft by means of a handle, in particular by means of a starter handle or pull handle, is rotatable by way of a load transfer means, in particular by way of a starter rope or pull-rope, and by way of an elastic coupling element, in particular by way of a spiral spring, is connected to an engaging element, in particular to a ratchet-type engaging element, by means of which the drive torque can be transmitted to the motor shaft, characterised in that the angle of rotation by which the ratchet-type engaging element is rotatable in relation to the pulley or rope drum by exerting a load on the elastic coupling element is limitable to a specifiable maximum angular value by a limit stop arranged on an underside of the engaging element, which underside faces the pulley or rope drum, said limit stop guided in a guide groove recessed in the pulley or rope drum.

2. The starting device according to claim 1, characterised in that the limit stop is shaped as a circular segment or arc-shaped segment, and the guide groove is formed in the manner of a section of an arc of a circle.

3. The starting device according to claim 2, characterised in that, for the purpose of achieving the maximum angular value, the limit stop comes to rest against a rest surface in particular at the end of the guide groove.

4. The starting device according to claim 3, characterised in that the rest surface is formed by the closed end of the guide groove and/or in the form of a limit stop damping device, in particular a limit stop damping device made of elastomer material, provided for damped stopping of the rotary movement.

5. A starting device for an internal combustion engine, in particular a pull-rope type starting device for a two-stroke or four-stroke motor, which comprises at least one pulley or rope drum which is rotatably held in a housing, wherein said starting device, for generating the drive torque for a motor shaft by means of a handle, in particular by means of a starter handle or pull handle, is rotatable by way of a load transfer means, in particular by way of a starter rope or pull-rope, and by way of an elastic coupling element, in particular by way of a spiral spring, is connected to an engaging element, in particular to a ratchet-type engaging element, by means of which the drive torque can be transmitted to the motor shaft, characterised in that the angle of rotation by which the ratchet-type engaging element is rotatable in relation to the pulley or rope drum by exerting a load on the elastic coupling element is limitable to a specifiable maximum angular value by two limit stops arranged so as to be essentially diametrically opposed to each other, and/or so as to be offset by approximately 180 degrees in relation to each other, on an underside of the engaging element, which underside faces the pulley or rope drum.

6. The starting device according to claim 5, characterised in that each of the two limit stops is guided in a respective guide groove, and in that the guide grooves are arranged in the pulley or rope drum so as to be essentially mirror inverted, and/or so as to be offset by approximately 180 degrees in relation to each other.

7. The starting device according to claim 6, characterised in that, for the purpose of achieving the maximum angular value, the two limit stops come to rest against respective rest surfaces at the same time, in particular at the end of their respective guide groove.

8. The starting device according to claim 1, characterised in that the maximum angular value which is provided when the starting device is activated, in particular when the handle is pulled, is in the magnitude of approximately 270 degrees to approximately 280 degrees divided by the number of limit stops used, i.e. in particular in the magnitude of approximately 270 degrees to approximately 280 degrees if one limit stop is provided; or in the magnitude of approximately 135 degrees to approximately 140 degrees if two limit stops are provided.

9. The starting device according to claim 1, characterised in that in the case of the coupling element failing or breaking down, the engaging element is rotatable if the starting device is activated, in particular if the handle is pulled.

10. The starting device according to claim 3, characterised in that in the case of the coupling element failing or breaking down, the engaging element, as a result of the limit stop resting against the rest surface, is rotatable when the starting device is activated, in particular when the handle is pulled.

11. The starting device according to claim 1, characterised in that the coupling element is pretensioned or comprises pretension.

* * * * *